US009269301B2

(12) United States Patent
Lee et al.

(10) Patent No.: US 9,269,301 B2
(45) Date of Patent: Feb. 23, 2016

(54) SELF-LIGHTING DISPLAY DEVICE AND METHOD OF DRIVING THE SAME

(71) Applicant: Samsung Display Co., Ltd., Yongin, Gyeonggi-Do (KR)

(72) Inventors: Baek-Woon Lee, Yongin (KR); Do-Ik Kim, Yongin (KR)

(73) Assignee: Samsung Display Co., Ltd. (KR)

( * ) Notice: Subject to any disclaimer, the term of this patent is extended or adjusted under 35 U.S.C. 154(b) by 250 days.

(21) Appl. No.: 14/013,985

(22) Filed: Aug. 29, 2013

(65) Prior Publication Data

US 2014/0354698 A1 Dec. 4, 2014

(30) Foreign Application Priority Data

May 28, 2013 (KR) ..... 10-2013-0060470

(51) Int. Cl.
*G09G 3/32* (2006.01)
*G09G 5/10* (2006.01)

(52) U.S. Cl.
CPC ..... *G09G 3/3258* (2013.01); *G09G 3/3233* (2013.01); *G09G 3/3275* (2013.01); *G09G 5/10* (2013.01); *G09G 2300/0866* (2013.01); *G09G 2320/0271* (2013.01); *G09G 2320/0606* (2013.01); *G09G 2320/0666* (2013.01); *G09G 2330/021* (2013.01); *G09G 2330/025* (2013.01); *G09G 2330/028* (2013.01); *G09G 2360/16* (2013.01)

(58) Field of Classification Search
CPC ..... G09G 2300/0842; G09G 2320/0271; G09G 2330/021; G09G 2360/16; G09G 3/3233; G09G 2300/0866; G09G 2320/0606; G09G 2320/0666; G09G 2330/025; G09G 2330/028; G09G 3/3258; G09G 3/3275; G09G 5/10
USPC ..... 345/204–213, 690–699
See application file for complete search history.

(56) References Cited

U.S. PATENT DOCUMENTS

| | | | | |
|---|---|---|---|---|
| 2004/0046718 | A1 | 3/2004 | Osame et al. | |
| 2005/0116657 | A1 | 6/2005 | Park et al. | |
| 2008/0055289 | A1* | 3/2008 | Kim et al. | 345/204 |
| 2008/0158218 | A1* | 7/2008 | Kim | 345/212 |
| 2009/0027375 | A1* | 1/2009 | Ryu et al. | 345/212 |
| 2009/0147032 | A1* | 6/2009 | Kim | 345/690 |
| 2010/0171733 | A1* | 7/2010 | Kobayashi | G09G 3/3208 345/211 |
| 2011/0012819 | A1* | 1/2011 | Ryu et al. | 345/82 |
| 2011/0115832 | A1 | 5/2011 | Lee et al. | |
| 2011/0316893 | A1 | 12/2011 | Lee et al. | |

FOREIGN PATENT DOCUMENTS

| | | | |
|---|---|---|---|
| KR | 10-2007-0092856 | A | 9/2007 |
| KR | 10-2008-0027421 | A | 3/2008 |
| KR | 10-2008-0064525 | A | 7/2008 |

OTHER PUBLICATIONS

EP 13192233.8 European Search Report dated Jul. 29, 2014.

* cited by examiner

*Primary Examiner* — Dmitriy Bolotin
(74) *Attorney, Agent, or Firm* — Innovation Counsel LLP

(57) ABSTRACT

The self-lighting subpixels of a display device are ones whose output luminances are functions of analog drive voltages applied to the subpixels and corresponding digital grayscale command signals used for controlling the subpixels. The display device generates corresponding analog dimming values and digital dimming values in accordance with supplied current limiting parameters and generates control value signals using the analog dimming values and the digital dimming values. It also changes the original grayscale digital data values of input video signals of one frame in accordance with the digital dimming values.

21 Claims, 9 Drawing Sheets

SELF-LIGHTING DISPLAY DEVICE AND METHOD OF DRIVING THE SAME

CROSS-REFERENCE TO RELATED APPLICATION

This application claims priority to and the benefit of Korean Patent Application No. 10-2013-0060470 filed in the Korean Intellectual Property Office on May 28, 2013, the entire contents of which application are incorporated herein by reference.

BACKGROUND (a) Field

The present disclosure of invention relates to a self-lighting display device and a method of driving the same. More particularly, the present disclosure relates to an organic light emitting display and a method of driving the same.

(b) Description of Related Technology

Recently, various thin (e.g., flat or curved) panel displays capable of reduced weight and volume have been developed.

Examples of such thin (e.g., flat) panel display devices include liquid crystal displays (LCD's), field emission displays (FED's), plasma display panels (PDP's), and organic light emitting display devices (OLEDD's).

In particular, since the organic light emitting type of display device produces an image using organic light emitting diodes (OLED's) as its light sources; that is to say, it is a self-emission type of display device, then the current and power drawn by the device tends to increase as an average picture luminance level (APL) increases. It would be advantageous to have a method of opportunistically reducing power consumption when the opportunities present themselves.

In a conventional method of driving an organic light emitting display device (OLEDD), only digital data is used to define the desired grayscales of RGB light source based on pixel data signals input from the outside. These digitally defined grayscales are changed on a frame by frame basis. However, when a so-called, ADS (Alternating Data Sets ???) method is applied whereby an input image frame is split into a plurality of temporally-driven subfields (also known as over-time dithering), a same resolution can be obtained by the ADS method while the number of actually displayed grayscales in each subfield is reduced. In addition, when all of the pixels of a subfield are simultaneously turned on in order to display a specific bright grayscale during a given subfield, a relatively large current simultaneously flows to power all of the high-luminance producing OLED's so that the instantaneous current draw for the given subfield is undesirably large and a correspondingly large amount of power is drawn for that displaying that subfield. Some of that drawn power may be wasted power.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

In accordance with one embodiment of the present disclosure of invention, power draw limits are set and a display device is provided that is capable of controlling instantaneous current and instantaneous power draw to generally have values no more than the established limit values while at the same time, not reducing the number of displayable grayscales (e.g., to only darker luminance ones). A method of driving the display device is also provided.

According to an exemplary embodiment, a display device includes a frame operation processor, an image data processor, a display, and a power supply. The frame operation processor generates analog dimming values and digital dimming values in accordance with supplied current limiting parameters and generates subpixel drive control value signals using the analog dimming values and the digital dimming values. The image data processor changes original grayscale data of input video signals of a frame in accordance with the generated digital dimming values. The display includes a plurality of self-lighting sub-pixels and displays an image corresponding to the video signals through the plurality of sub-pixels. The power supply is a variable one that controls power source voltages applied to the subpixels in accordance with the control value signals and supplies the controlled power source voltages to the plurality of sub-pixels.

The power source voltages include first power source voltages supplied to anodes of organic light emitting diodes of the plurality of sub-pixels and second power source voltages supplied to cathodes of the organic light emitting diodes and the power supply may control the first power source voltages in accordance with the control value signals.

The current limiting parameters include a screen color temperature, a power consumption limiting value, and a user dimming value and the frame operation processor may include a current operator, a dimming value operator, and a voltage controller.

The current value operator calculates actual current values in the frame using the screen color temperature. The dimming value operator generates the analog dimming values and the digital dimming values using the actual current values, the power consumption limiting value, and the user dimming value and calculates target current values in the frame using the analog dimming values and the digital dimming values. The voltage controller compares measured current values drawn by the pixel with the target current values to generate the control value signals.

The power supply may measure current values flowed from the power source voltages and supplied to the sub-pixels to output the measured current values to the voltage controller.

The voltage controller may generate its control value signals so as to increase the respective power source voltages when the measured current values are less than the target current values.

The dimming value operator may include a net power control (NPC) logic processor, a divider, and a dimming value determiner. The net power control (NPC) logic processor determines a scale variable of a corresponding frame by a load factor calculated by the actual current values in the frame. The divider divides the scale variable into analog scale variables and digital scale variables. The dimming value determiner generates the analog dimming values using the analog scale variables and the user dimming value and generates the digital dimming values using the digital scale values and the user dimming value.

The dimming value operator may include a target current value operator for calculating the target current values by multiplications of the analog dimming values, the digital dimming values, and the actual current values.

The image data processor may include a digital dimming operator for multiplying the grayscale data of the video signals of the frame by the digital dimming values to change the grayscale data of the original video signals.

The control value signals may be pulse width modulated (PWM) signals or they may be digital values for designating corresponding voltage levels.

A plurality of sub-pixels may be divided into first sub-pixels of a first color and second sub-pixels of a different second color, the power source voltages may include a first power source voltage supplied to anodes of organic light emitting diodes of the first sub-pixels and a second power source voltage supplied to anodes of organic light emitting diodes of the second sub-pixels, and the power supply may control the first power source voltage and the second power source voltage in accordance with the corresponding control value signals.

The control value signals may include a first control value corresponding to the first color and a second control value corresponding to the second color, the analog dimming values may include a first analog dimming value corresponding to the first color and a second analog dimming value corresponding to the second color, and the digital dimming values may include a first digital dimming value corresponding to the first color and a second digital dimming value corresponding to the second color.

According to another exemplary embodiment, there is provided a method of driving a display device including a plurality of self-lighting sub-pixels. The method includes generating analog dimming values and digital dimming values in accordance with supplied current limiting parameters input from the outside, generating control value signals using the analog dimming values and the digital dimming values, controlling power source voltages supplied to organic light emitting diodes of the plurality of sub-pixels in accordance with the control value signals, and displaying an image corresponding to video signals of one frame input from the outside through the plurality of sub-pixels.

In displaying the image, original grayscale data of the input video signals is changed using the digital dimming values.

The power source voltages may be supplied to anodes of the organic light emitting diodes of the plurality of sub-pixels.

A plurality of sub-pixels are divided into first sub-pixels of a first color and second sub-pixels of a second color and the power source voltages may include a first power source voltage supplied to anodes of organic light emitting diodes of the first sub-pixels and a second power source voltage supplied to anodes of organic light emitting diodes of the second sub-pixels.

The current limiting parameters may include a screen color temperature, a power consumption limiting value, and a user dimming value and generating the analog dimming values and the digital dimming values may include calculating actual current values of the video signals using the screen color temperature, calculating analog scale variables and digital scale variables using the actual current values and the power consumption limiting value, generating the analog dimming values using the analog scale variables and the user dimming value, and generating the digital dimming values using the digital scale variables and the user dimming value.

Generating the control value signals may include calculating target current values in the frame using the analog dimming values and the digital dimming values, measuring current values flown by power source voltages supplied to the plurality of sub-pixels, and comparing the measured current values with the target current values to generate the control value signals.

Comparing the measured current values with the target current values to generate the control value signals may include generating the control value signal so as to increase the corresponding power source voltages when the measured current values are less than the target current values and generating the control value signals so as to reduce the corresponding power source voltages when the measured current values are not less than the target current values.

DETAILED DESCRIPTION

Figure 1:
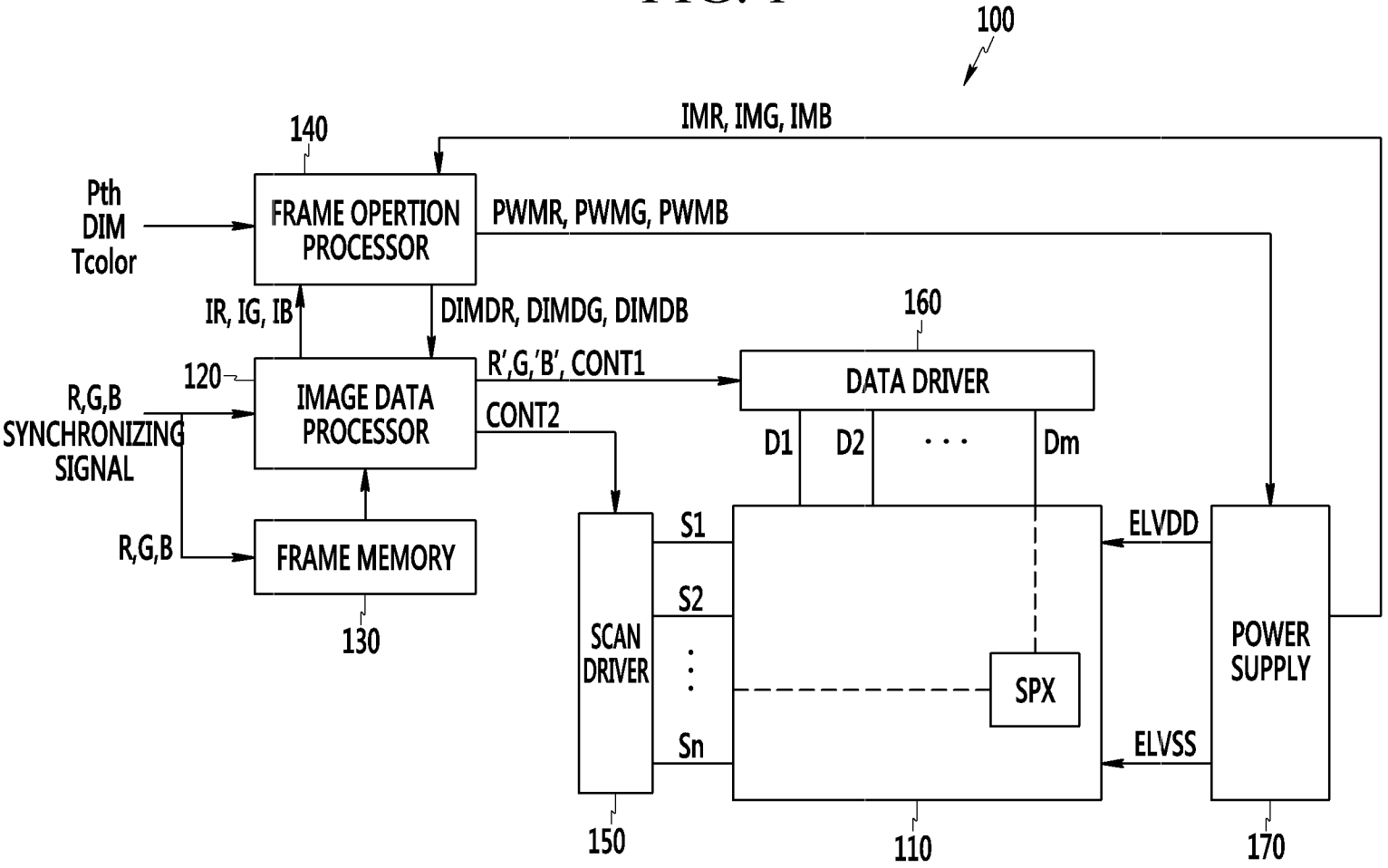
FIG. 1 is a schematic view illustrating a self-lighting display device according to an exemplary embodiment of the present disclosure of invention.

In the following detailed description, only certain exemplary embodiments of the present teachings are shown and described with the understanding that this is simply by way of illustration. As those skilled in the art would realize after appreciating the present disclosure, the described embodiments may be modified in various different ways, all without departing from the spirit or scope of the present teachings. Accordingly, the drawings and description are to be regarded as illustrative in nature and not restrictive. Like reference numerals designate like elements throughout the specification.

Throughout the specification and claims, unless explicitly described to the contrary, the word "comprise" and variations such as "comprises" or "comprising" will be understood to imply the inclusion of stated elements but not the exclusion of any other elements.

Throughout this specification and the claims that follow, when it is described that an element is "connected" to another element, the element may be directly connected to the other element or may be "electrically connected" to the other element with other elements interposed. In addition, unless explicitly described to the contrary, the word "comprise" and variations such as "comprises" or "comprising" will be understood to imply the inclusion of stated elements but not the exclusion of any other elements.

A display device according to an exemplary embodiment of the present disclosure of invention and a method of driving the same will be described in detail with reference to the accompanying drawings.

Figure 2:
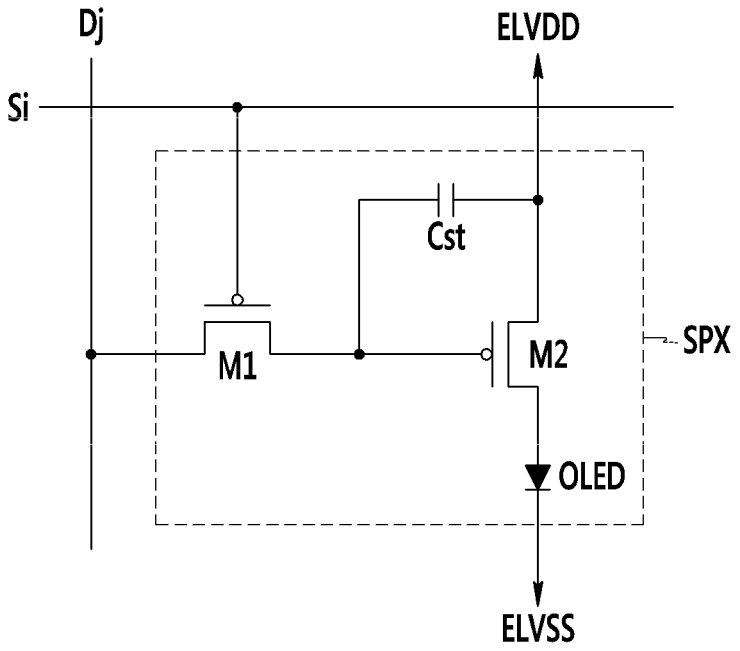
FIG. 2 is a view illustrating one of a plurality of sub-pixels according to an exemplary embodiment.

FIG. 1 is a schematic illustrating a display device 100 according to an exemplary embodiment. FIG. 2 is a circuit diagram illustrating one of a plurality of sub-pixels according to an exemplary embodiment.

First referring briefly to FIG. 2 and for the purpose of setting context, the illustrated OLED is an example of a self-emitting, controlled light source where the amount of current I passed through the OLED determines its luminance output (brightness). At the same time, power may be wasted by the controlling transistor M2 as waste heat and in accordance with the equation, $P_{waste}=I^2*R_{DS}$, where $R_{DS}$ is the drain to source resistance of the controlling transistor M2. This drain to source resistance $R_{DS}$ can be reduced while the drive current I passed through the OLED is kept unchanged by increasing the gate drive voltage of the controlling transistor M2 and simultaneously decreasing the voltage drop between voltage nodes $ELV_{DD}$ and $ELV_{SS}$. Herein, the controlling of the gate drive voltage of the controlling transistor M2 will be referred to as a "digital" control and the controlling of the voltage drop between voltage nodes $ELV_{DD}$ and $ELV_{SS}$ will be referred to as an "analog" control.

Next, referring in more detail to FIG. 1, the illustrated display device 100 that is configured in accordance with the present disclosure of invention includes a display panel 110, an image data processor 120, a frame memory 130, a frame operation processor 140, a scan driver 150, a data driver 160, and a power supply 170. With regard to the latter power supply 170, it may be seen that control signals PWM-Red, PWM-Green and PWM-Blue are supplied from the frame operation processor 140 to the power supply 170 and that the power supply 170 responsively produces the panel drive voltages $ELV_{DD}$ and $ELV_{SS}$.

The display panel 110 includes a substrate having disposed thereon a plurality of data lines D1 to Dm extending in a column direction and a plurality of scan lines S1 to Sn extending in a row direction. A plurality of sub-pixels SPX (one shown) are arranged in matrix form at the intersections of corresponding ones of the data lines Dj and scan lines Si (where j and i are appropriate integers). More specifically, In one embodiment, the plurality of sub-pixels SPX each respectively display one of the red R, green G, and blue B primary colors. However, the present disclosure is not limited to just this tri-color arrangement and other combinations of colors and/or output of white light (W) by respective subpixels is contemplated.

The plurality of data lines D1 to Dm transmit analog drive signals corresponding to digital data video signals R', G', and B' output by the image data processor 120. The transmitted analog drive signals, (on D1 to Dm) are correspondingly coupled to the plurality of sub-pixels SPX at the same time that an activated one of the scan lines S1 to Sn transmits an activating scan signal to one of the rows for selecting the row of sub-pixels SPX that will respond to then output analog drive signals, (on D1 to Dm). Although not seen in FIG. 1, each sub-pixel SPX includes a storage means (see Cst of FIG. 2) for storing the respective analog drive signal sent to it (on D1 to Dm) when its row is activated by a corresponding one of the scan signals (S1 to Sn). That stored analog drive signal will in part determine the subpixel driving current, $I_{ij}$ of the respective sub-pixel SPX(i,j) for a given frame period such that the respective light emitting elements (e.g., OLED's) emit light components (e.g., R, G, B) corresponding to their driving currents ($I_{ij}$) called for by the corresponding digital data signals R', G', and B' output by the image data processor 120. The outputting of the digital data signals R', G', and B' is synchronized to a first driving control signal CONT1.

The scan driver 150 transmits the plurality of scan signals to the scan lines S1 to Sn in accordance with a second driving control signal CONT2. The first and second driving control signals, CONT1 and CONT2, are output by the image data processor 120.

Referring now to the details of FIG. 2, each sub-pixel $SPX_{i,j}$ according to an exemplary embodiment is connected to its respective ith scan line Si and jth data line Dj. The sub-pixel SPX includes a switching (a.k.a. addressing) transistor M1 and a driving transistor M2. The sub-pixel SPX further includes a storage capacitor Cst, and an organic light emitting diode OLED. In FIG. 2, the switching transistor M1 and the driving transistor M2 are illustrated as p-channel metal oxide semiconductor transistors (PMOS's). However, it is within the contemplation of the disclosure to use other kinds of transistors, including NMOS ones instead of all PMOS transistors.

The switching transistor M1 includes a gate electrode connected to the scan line Si, a source electrode connected to the data line Dj, and a drain electrode connected to a gate electrode of the driving transistor M2 (and to one electrode of the storage capacitor Cst).

The driving transistor M2 includes a source electrode connected to a DD power source voltage ELVDD, a drain electrode connected to an anode electrode of the organic light emitting diode OLED, and a gate electrode to which a data signal is transmitted in a period where the switching transistor M1 is turned on.

The capacitor Cst is connected between the gate electrode and the source electrode of the driving transistor M2 and source electrode. A cathode electrode of the organic light emitting diode OLED is connected to a SS power source voltage ELVSS.

A detailed operation of the sub-pixel SPX will be described as follows. When the switching transistor M1 is turned on by the scan signal transmitted through the scan line Si, the data signal transmitted through the data line Dj is transmitted to the gate electrode of the driving transistor M2 and is also captured by the storage capacitor Cst.

The capacitor Cst maintains a difference between a voltage of the gate electrode of the driving transistor M2 and a voltage of the source electrode of the driving transistor M2 during a uniform period (e.g., the image frame period). A driving current (I) flows through the driving transistor M2 where the magnitude of the driving current (I) is determined by the difference between the voltage of the gate electrode of the driving transistor M2 and the voltage of the source electrode of the driving transistor M2. The organic light emitting diode OLED emits light having an intensity corresponding to the magnitude of the driving current.

Referring to FIG. 1 again, the power supply 170 supplies the power source voltages ELVDD and ELVSS to the sub-pixel SPX.

Figure 3:
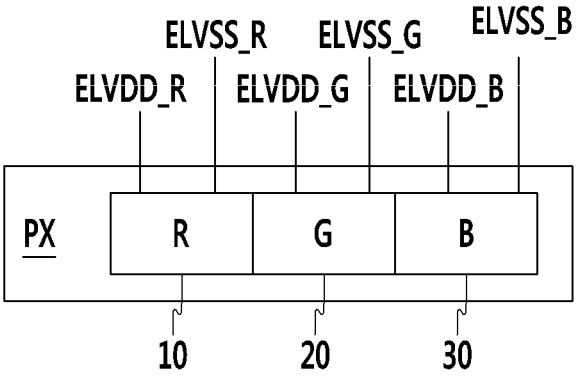
FIG. 3 is a view illustrating an example of the separate power source voltages supplied to a pixel according to an exemplary embodiment of the present disclosure.

Each of the different kinds of OLED's (e.g., R, G, B) may have its own respective set of power source voltages ELVDD and ELVSS. FIG. 3 is a schematic illustrating an example of individualized power source voltages supplied to the respective subpixels according to an exemplary embodiment of the present disclosure.

Referring to FIG. 3, each pixel PX may include its respective red R, green G, and blue B sub-pixels 10, 20, and 30.

The power source voltage ELVDD may include a power source voltage ELVDD_R supplied to the red R sub-pixel 10, a power source voltage ELVDD_G supplied to the green G sub-pixel 20, and a power source voltage ELVDD_B supplied to the blue B sub-pixel 30. The power source voltages ELVDD_R, ELVDD_G, and ELVDD_B may be the same as one another or they may be different voltages.

In addition, the power source voltage ELVSS may include a power source voltage ELVSS_R supplied to the red R sub-pixel 10, a power source voltage ELVSS_G supplied to the green G sub-pixel 20, and a power source voltage ELVSS_B supplied to the blue B sub-pixel 30. The power source voltages ELVSS_R, ELVSS_G, and ELVSS_B may be the same as one another or they may be different voltages.

Referring to FIGS. 1 and 3 again, the power supply 170 receives control values PWMR, PWMG, and PWMB corresponding to the red R, green G, and blue B sub-pixels 10, 20, and 30 from the frame operation processor 140 and controls the power source voltages ELVDD_R, ELVDD_G, and ELVDD_B in accordance with the control values PWMR, PWMG, and PWMB.

As described above, when the power source voltages ELVDD_R, ELVDD_G, and ELVDD_B are controlled in accordance with the control values PWMR, PWMG, and PWMB such that the wasted power $P_{waste}=I^2*R_{DS}$ of M2 is reduced, it is desirable that the display of grayscales will not be affected at all. To do this, the digital data signals, R', G', and B' are increased while the analog power source voltage drops ELVDD minus ELVDD are decreased. One way to do this is to increase the ELVDD levels so that the voltage across Cst is increased even without changing the absolute values of the drive voltages on data lines D1 to Dm. At the same time, the ELVSS levels may be raised in a manner which does not change the corresponding magnitude of the OLED driving current (I). As a result, the number of grayscales may be maintained and the peak power consumption of the panel 110 is reduced. In one embodiment, while the number of different grayscales discernible by the human eye is kept the same, the maximum amount of light emission produced by respective OLED's across respective ones of plural subfields is reduced (e.g., smoothed out) and as a result, peak current consumption of the organic light emitting diode OLED per a subfield may be reduced.

In addition, the power supply 170 measures for feedback purposes, the currents IMR, IMG, and IMB drawn by the sub-pixels 10, 20, and 30 in response to by the power source voltages ELVDD_R, ELVDD_G, and ELVDD_B supplied to the sub-pixels 10, 20, and 30. The power supply 170 and transmits the measured current values IMR, IMG, and IMB to the frame operation processor 140.

The image data processor 120 receives video signals R, G, and B of a current frame including red R, green G, and blue B grayscale digital data and a corresponding synchronizing signal (e.g., VSYNC) from the outside. The image data processor 120 generates the first and second driving control signals CONT1 and CONT2 from the video signals R, G, and B of the current frame and the synchronizing signal.

The input video signals R, G, and B of the current frame are stored in the frame memory 130. The frame memory 130 delays the input video signals R, G, and B by at least one frame and outputs the delayed video signals R, G, and B to the image data processor 120.

The image data processor 120 derives ideal current values IR, IG, and IB from the video signals R, G, and B of the current frame and outputs the operated ideal current values IR, IG, and IB to the frame operation processor 140. The ideal current values IR, IG, and IB are normalized so that IR:IG:IB=1:1:1 in full white.

In addition, the image data processor 120 receives digital dimming values DIMDR, DIMDG, and DIMDB corresponding to the red R, green G, and blue B sub-pixels 10, 20, and 30 of the frame from the frame operation processor 140 and changes grayscale data of the input video signals R, G, and B as delayed by one or more frames and output in delayed form from the frame memory 130 using the received digital dimming values DIMDR, DIMDG, and DIMDB.

Derivations of the ideal current values IR, IG, and IB of one frame are completed after all of the video signals R, G, and B of the corresponding frame have been input to the image data processor 120. In order to receive the digital dimming values DIMDR, DIMDG, and DIMDB calculated using the ideal current values IR, IG, and IB of one frame from the frame operation processor 140 and to apply the received digital dimming values DIMDR, DIMDG, and DIMDB to the video signals R, G, and B of the corresponding frame, the video signals R, G, and B of the corresponding frame must be delayed by at least one frame. Therefore, the frame memory 130 is required, the video signals R, G, and B of the current frame that are input from the outside are stored in the frame memory 130, and the frame memory 130 delays the input video signals R, G, and B of the current frame by at least one frame and outputs the delayed video signals R, G, and B to the image data processor 120.

The image data processor 120 outputs the modified video signals R' G' and B' of the changed grayscale data and the first driving control signal CONT1 to the data driver 160 and outputs the second driving control signal CONT2 to the scan driver 150.

The frame operation processor 140 receives from an external control source, a plurality of current limiting parameters Pth, DIM, and Tcolor for defining limits to the current draw of the panel 110. It also receives the ideal current values IR, IG, and IB of the video signals R, G, B of the current frame from the image data processor 130 to finally generate "analog" dimming values DIMAR, DIMAG, and DIMAB (see FIG. 5) and corresponding "digital" dimming values DIMDR, DIMDG, and DIMDB. The current limiting parameter Pth is a power consumption limiting value. The current limiting parameter DIM is a user selected image dimming value desired by a user. The current limiting parameter Tcolor represents a screen color temperature.

Using the generated analog dimming values DIMAR, DIMAG, and DIMAB, the frame operation processor 140 generates the respective color powering control values PWMR, PWMG, PWMB to control the respective power source voltages ELVDD_R, ELVDD_G, and ELVDD_B supplied to the sub-pixels 10, 20, and 30. The frame operation processor 140 also outputs the digital dimming values DIMDR, DIMDG, and DIMDB to the image data processor 120, and it outputs the respective color powering control values PWMR, PWMG, and PWMB to the power supply 170.

Figure 4:
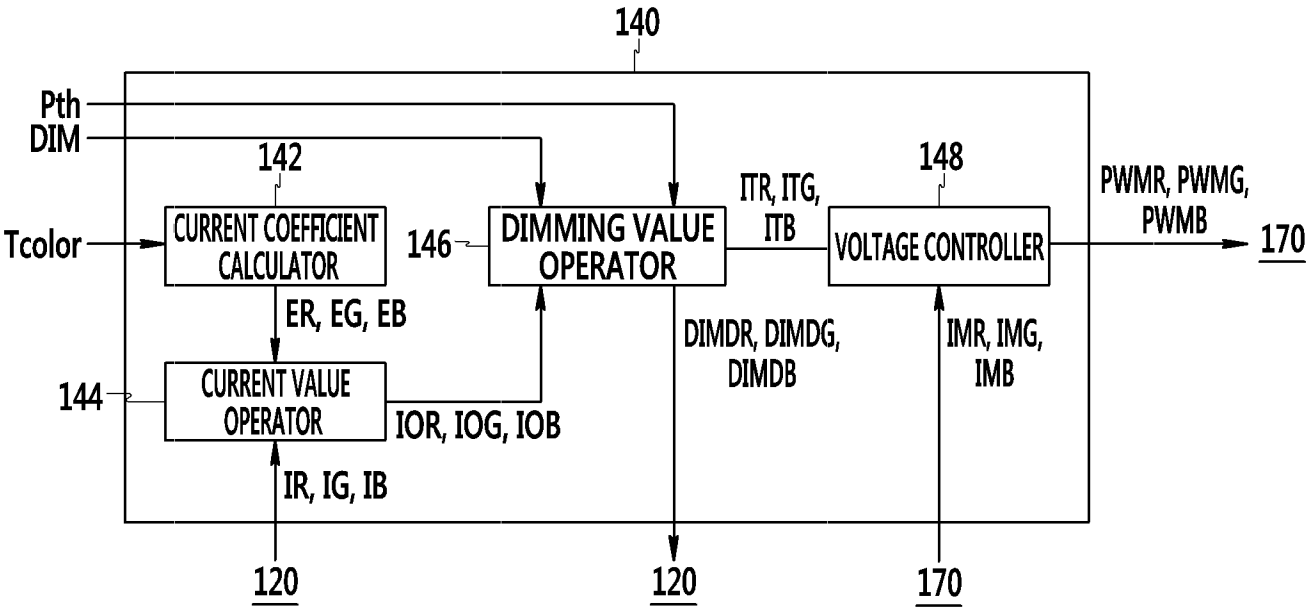
FIG. 4 is a view illustrating an example of the frame operation processor illustrated in FIG. 1.

FIG. 4 is a schematic diagram illustrating an example of the frame operation processor 140 illustrated in FIG. 1.

Referring to FIG. 4, the frame operation processor 140 includes a current coefficient calculator 142, a current value operator module 144, a dimming value operator module 146, and a voltage controller 148. The frame operation processor 140 may be realized by a field-programmable gate array (FPGA) or a micro controller unit (MCU) and produces its operational results in units of frames per second, for example, 60 Hz.

The current coefficient calculator 142 stores red R, green G, and blue B current coefficient values in accordance with the screen color temperature and outputs red R, green G, and blue B current coefficient values ER, EG, and EB corresponding to the screen color temperature Tcolor input from the outside to the current value operator 144. For example, ER:EG:EB may be 0.50:0.50:1.0 when the screen color temperature Tcolor is 10,000K and may be 0.53:0.50:073 when the screen color temperature Tcolor is 6,500K.

At this time, the current coefficient calculator 142 may store the red R, green G, and blue B current coefficient values in accordance with the screen color temperature in the form of a lookup table (LUT) and/or may use an algorithm to calculate a current coefficient value corresponding to the screen color temperature based on red R, green G, and blue B color coordinates.

The current value operator 144 multiplies the ideal currents IR, IG, and IB output from the image data processor 120 by the respective current coefficient values ER, EG, and EB to calculate actual current values IOR, IOG, and IOB of video signals R, G, and B to be displayed in a corresponding frame.

The dimming value operator 146 generates the analog dimming values DIMAR, DIMAG, and DIMAB and the digital dimming values DIMDR, DIMDG, and DIMDB in accordance with the actual current values IOR, IOG, and IOB calculated by the current value operator 144 and the power consumption limiting value Pth and the dimming value DIM input from the outside.

The dimming value operator 146 calculates target current values ITR, ITG, and ITB of the sub-pixels 10, 20, and 30 to be actually displayed with dimming applied as illustrated in a below equation 1 using the analog dimming values DIMAR, DIMAG, and DIMAB, the digital dimming values DIMDR, DIMDG, and DIMDB, and the actual current values IOR, IOG, and IOB. The dimming value operator 146 outputs the calculated target current values ITR, ITG, and ITB to the voltage controller 148.

$$ITR=IOR*DIMAR*DIMDR+I\text{offset}$$

$$ITG=IOG*DIMAG*DIMDG+I\text{offset}$$

$$ITB=IOB*DIMAB*DIMDB+I\text{offset} \quad \text{(Equation 1)}$$

In the equation 1, Ioffset represents a current when in black.

The voltage controller 148 compares the target current values ITR, ITG, ITB calculated by the dimming value operator 146 with the measured current values IMR, IMG, and IMB measured by the power supply 170 to generate the corresponding control values PWMR, PWMG, and PWMB and to output the generated control values PWMR, PWMG, and PWMB to the power supply 170. At this time, the control values PWMR, PWMG, and PWMB correspond to pulse width modulation (PWM) signals. That is, the power source voltages ELVDD_R, ELVDD_G, and ELVDD_B are applied to the red R, green G, and blue B sub-pixels 10, 20, and 30 in accordance with the pulse-width-modulated control value signals, PWMR, PWMG, and PWMB.

To be specific, and as an example; the voltage controller 148 generates the control value PWMR that increases the power source voltage ELVDD_R when the measured current value IMR is less than the target current value ITR and generates the control value PWMR that reduces the power source voltage ELVDD_R when the measured current value IMR is not less than the target current value ITR. The voltage controller 148 generates the control value PWMG that increases the power source voltage ELVDD_G when the measured current value IMG is less than the target current value ITG and generates the control value PWMG that reduces the power source voltage ELVDD_G when the measured current value IMG is not less than the target current value ITG. The voltage controller 148 generates the control value PWMB that increases the power source voltage ELVDD_B when the measured current value IMB is less than the target current value ITB and generates the feedback control value PWMB that reduces the power source voltage ELVDD_B when the measured current value IMB is not less than the target current value ITB.

Figure 5:
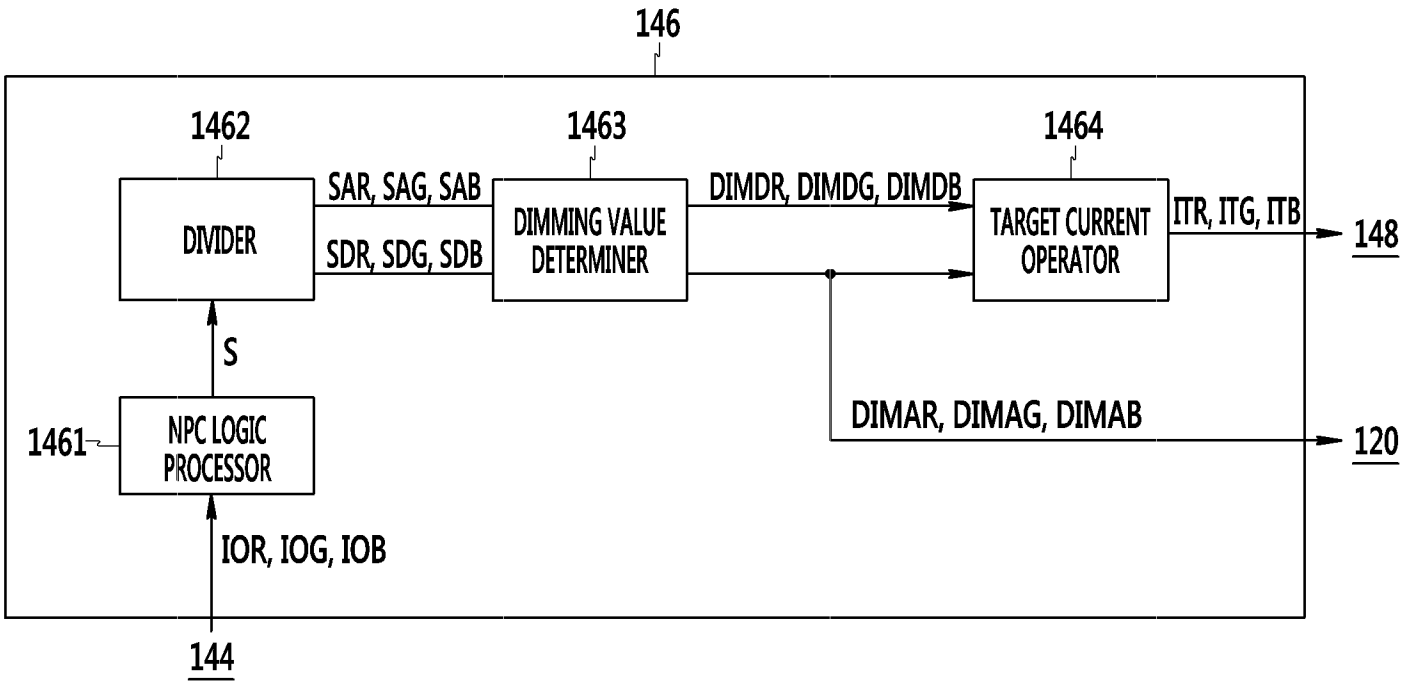
FIG. 5 is a view illustrating the dimming value operator illustrated in FIG. 4.
Figure 6:
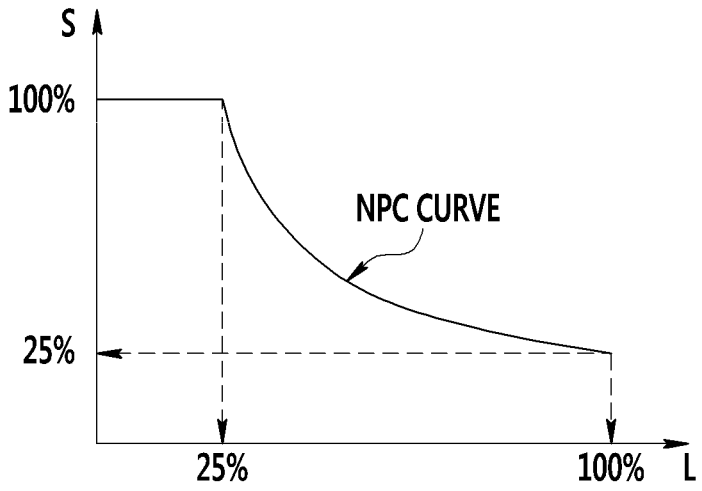
FIG. 6 is a view illustrating an example of a net power control (NCP) curve according to an exemplary embodiment.

FIG. 5 is a schematic diagram illustrating the dimming value operator illustrated in FIG. 4. FIG. 6 is a view illustrating an example of a net power control (NPC) curve according to an exemplary embodiment of the present disclosure of invention.

Referring to FIG. 5, the dimming value operator 146 includes an NPC logic processor 1461, a divider 1462, a dimming value determiner 1463, and a target current value operator 1464.

The NPC logic processor 1461 determines a scale variable S of a corresponding frame. At this time, respective red R, green G, and blue B scale variables may exist. The scale variable S of the corresponding frame is determined in accordance with a relation of the predetermined scale variable S and an input load L of the corresponding frame or a set NPC curve. At this time, the scale variable S is set so that current consumption and power consumption of the organic light emitting diode OLED for the given frame are not larger than a predetermined limiting value. The frame's input load factor, L is determined as illustrated in equation 2.

$$L = \frac{IOR + IOG + IOB}{IOR_{max} + IOG_{max} + IOB_{max}} \quad \text{(Equation 2)}$$

In the equation 2, $IOR_{max}$, $IOG_{max}$, and $IOB_{max}$ represent the allowed maximum values of the actual current values IOR, IOG, and IOB for the frame.

The divider 1462 divides the scale variable S determined by the NPC logic processor 1461 into red R, green G, and blue B analog scale variables SAR, SAG, and SAB and red R, green G, and blue B digital scale variables SDR, SDG, and SDB. At this time, the analog scale variables SAR, SAG, and SAB and the digital scale variables SDR, SDG, and SDB satisfy a relation of below equation 3.

$$S=SAR*SDR=SAG*SDG=SAB*SDB \quad \text{(Equation 3)}$$

The analog scale variables SAR, SAG, and SAB in accordance with the scale variable S may be stored in the form of a lookup table and may be calculated by a predetermined calculation. As described above, when the analog scale variables SAR, SAG, and SAB are determined, the digital scale variables SDR, SDG, SDB are determined as corresponding reciprocals relative to S per the equation 3.

The dimming value determiner 1463 determines the analog dimming values DIMAR, DIMAG, and DIMAB and the digital dimming values DIMDR, DIMDG, and DIMDB in accordance with the red R, green G, and blue B analog scale variables SAR, SAG, and SAB, the red R, green G, and blue B digital scale variables SDR, SDG, and SDB, and the supplied user dimming value DIM. The user dimming value DIM may be reflected only to determination of the analog dimming values and may be reflected only to determination of the digital dimming values. In addition, the user dimming value DIM may be distributed to the analog dimming values DIMAR, DIMAG, and DIMAB and the digital dimming values DIMDR, DIMDG, and DIMDB. For example, the user dimming value DIM may be distributed so that SAR*DIM*DIMAR=SD*DIM*DIMDR. Here, DIMAR*DIMDR=1.

The target current value operator 1464 calculates the target current values ITR, ITG, and ITB through the calculation of the equation 1 using the analog dimming values DIMAR, DIMAG, and DIMAB, the digital dimming values DIMDR, DIMDG, and DIMDB, and the actual current values IOR, IOG, and IOB and outputs the calculated target current values ITR, ITG, and ITB to the voltage controller 148.

On the other hand, in accordance with a method of realizing the power supply 170, the voltage controller 148 may output digital values for designating voltage levels of the power source voltages ELVDD_R, ELVDD_G, and ELVDD_B to the power supply 170. Such an exemplary embodiment will be described with reference to FIG. 7.

Figure 7:
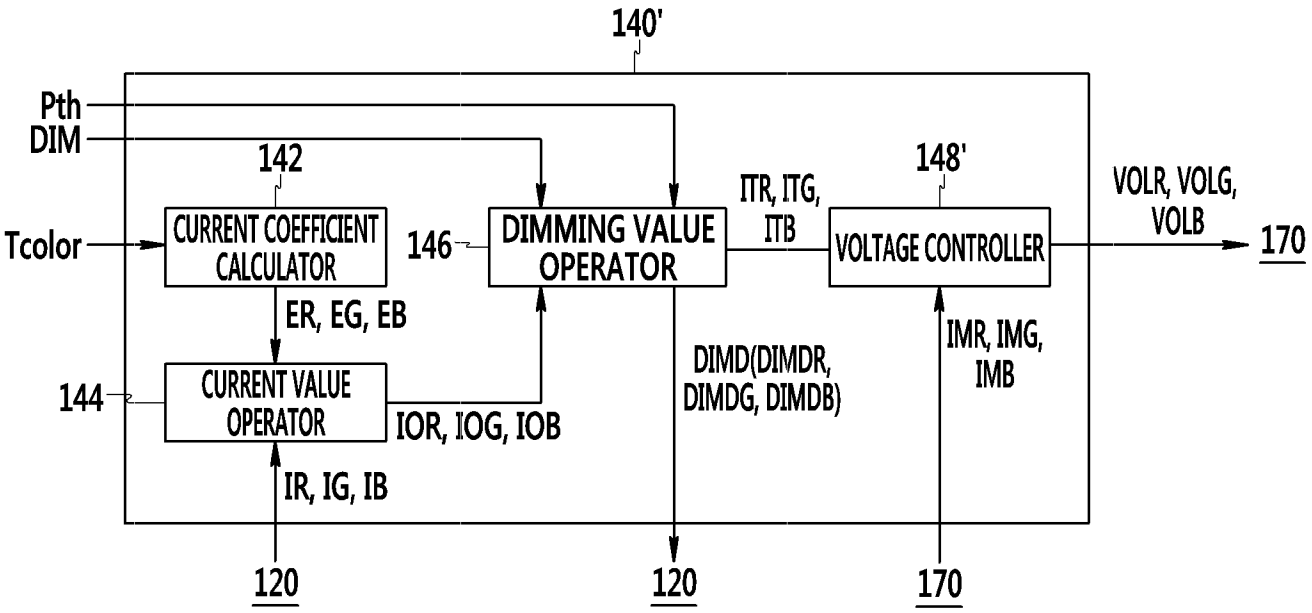
FIG. 7 is a view illustrating another example of the frame operation processor illustrated in FIG. 1.

FIG. 7 is a view illustrating another example of the frame operation processor illustrated in FIG. 1.

Referring to FIG. 7, a voltage controller 148' of a frame operation processor 140' compares the target current values ITR, ITG, and ITB calculated by the dimming value operator 146 with the measured current values IMR, IMG, and IMB measured by the power supply 170 to generate digital values VOLR, VOLG, and VOLB for output to the power supply 170 for thereby designating the voltage levels of the power source voltages ELVDD_R, ELVDD_G, and ELVDD_B.

When the power supply 170 receives the digital values VOLR, VOLG, and VOLB from the voltage controller 148', the digital values VOLR, VOLG, and VOLB are changed into corresponding analog voltage values by a digital-analog converter (DAC) (not shown) and the power source voltages ELVDD_R, ELVDD_G, and ELVDD_B are controlled in accordance with the analog voltage values. At this time, the DAC may be provided in the power supply 170 and may be separately provided from the power supply 170.

In addition, unlike in the above exemplary embodiment, the same power source voltage may be supplied to the red R, green G, and blue B sub-pixels 10, 20, and 30. As described above, when the power source voltages supplied to the red R, green G, and blue B sub-pixels 10, 20, and 30 are set the same (ELVDD_R=ELVDD_G=ELVDD_B), operation complexities of the frame operation processors 140 and 140' may be reduced and the power supply 170 may be also simplified.

Figure 8:
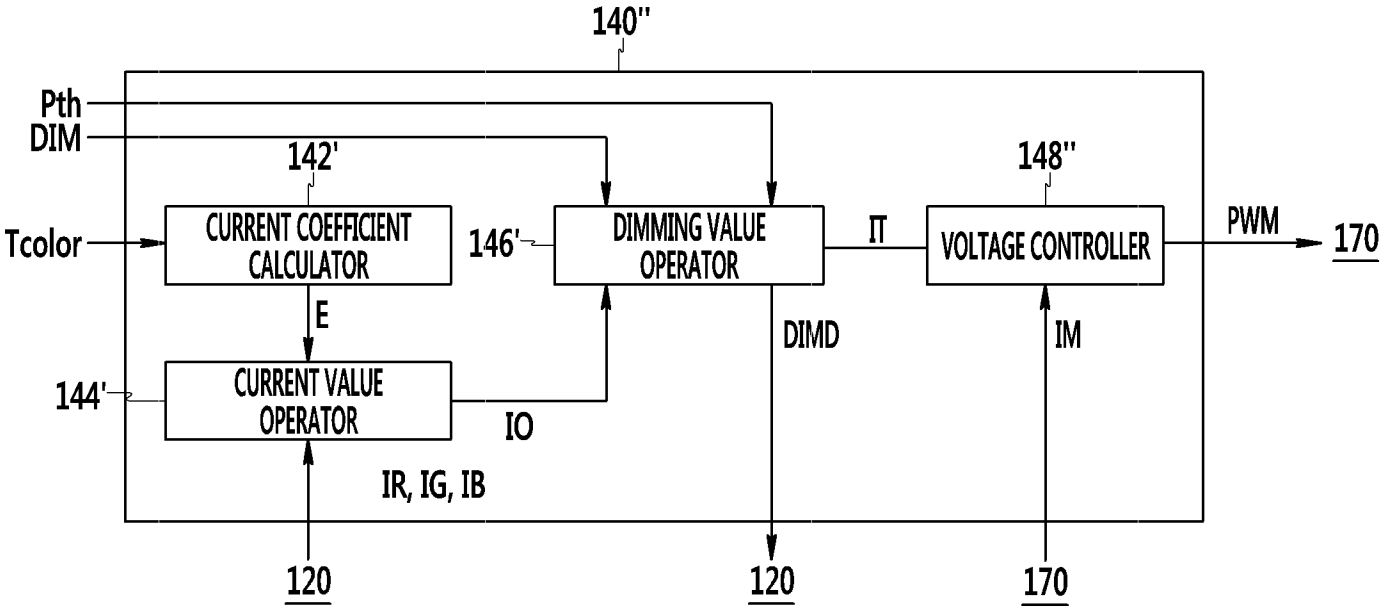
FIG. 8 is a view illustrating still another example of the frame operation processor illustrated in FIG. 1.

FIG. 8 is a view illustrating still another example of the frame operation processor illustrated in FIG. 1, in which the power source voltage supplied to the red R, green G, and blue B sub-pixels 10, 20, and 30 is set as a common ELVDD value for all colors.

Referring to FIG. 8, a current coefficient calculator 142' of a frame operation processor 140" stores a current coefficient value in accordance with a screen color temperature unlike in FIG. 4 and FIG. 7 and outputs a current coefficient value E corresponding to the screen color temperature input from the outside to a current value operator 144'.

The current value operator 144' multiplies the ideal current values IR, IG, and IB output from the image data processor 120 by the current coefficient value E and calculates an actual average current value IO.

The dimming value operator 146 determines a dimming level to be finally applied in accordance with the actual average current value IO calculated by the current value operator 144 and the power consumption limiting value Pth and the dimming value DIM input from the outside.

The dimming value operator 146 generates the analog dimming value DIMA and the digital dimming value DIMD from the determined dimming level and outputs the digital dimming value DIMD to the image data processor 120.

The dimming value operator 146 may calculate a target current value IT as illustrated in equation 4 using the analog dimming value DIMA, the digital dimming value DIMD, and the actual average current value IO. The dimming value operator 146 outputs the calculated target current value IT to the voltage controller 148.

$$IT=IO*DIMA*DIMD+Ioffset \quad \text{(Equation 4)}$$

The voltage controller 148 compares the target current value IT calculated by the dimming value operator 146 with a measured current value IM of a pixel PX measured by the power supply 170 to generate the control value PWM and to output the generated control value PWM to the power supply 170.

The power supply 170 controls the common power source voltage ELVDD in accordance with the received control value signal PWM for thereby outputting the correspondingly controlled, one power source voltage ELVDD to the red R, green G, and blue B sub-pixels 10, 20, and 30.

Figure 9:
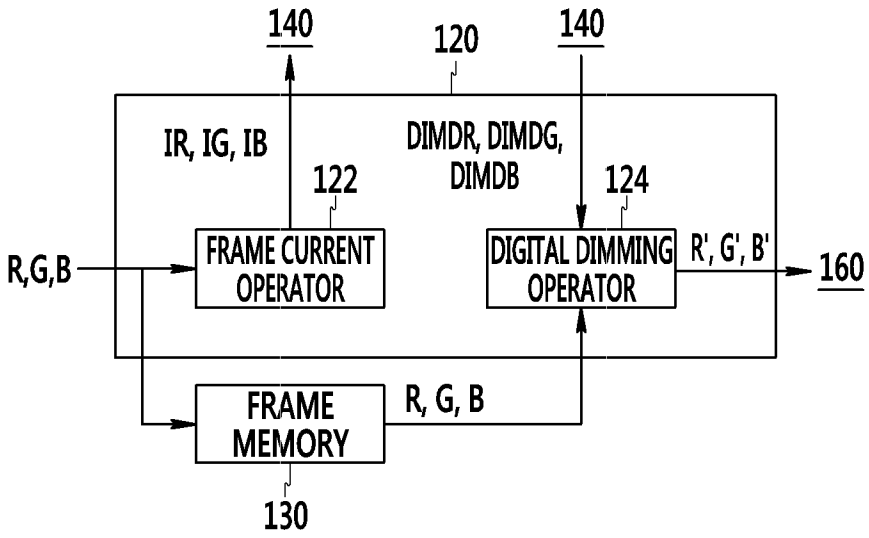
FIG. 9 is a view illustrating the image data processor illustrated in FIG. 1.

FIG. 9 is a view illustrating the image data processor 120 illustrated in FIG. 1.

Referring to FIG. 9, an image data processor 120 includes a frame current operator 122 and a digital dimming operator 124. The image data processor 120 may be realized by an application specific integrated circuit (ASIC) or a field programmable gate array (FPGA) and processes its operations in units of pixel clocks per second, for example, 70 MHz to 300 MHz.

The frame current operator 122 receives the video signals R, G, and B of the current frame including the red R, green G, and blue B grayscale data to operate the ideal current values IR, IG, and IB of one frame. When a gamma value of the display 110 is g, current of each pixel PX is proportional to an input grayscale value raised to the power of g.

The digital dimming operator 124 multiplies the grayscale data of the video signals R, G, and B of the current frame delayed by one or more frames by action of the frame memory 130 by the digital dimming values DIMDR, DIMDG, and DIMDB to change the grayscale data of the video signals R, G, and B and to output video signals R', G', and B' with changed grayscale data to the data driver 160.

According to the exemplary embodiments of the present disclosure, grayscales of RGB pixel data input from the outside are changed and the power source voltages ELVDD (color) of the respectively colored organic light emitting diodes OLED are controlled to reduce an amount of light emission or current consumption per subfield of a being displayed image. At this time, since display of grayscales is not affected at all, the number of distinct grayscales may be maintained and a peak current of a panel is limited or reduced. Therefore, current/power may be limited.

The exemplary embodiments of the present disclosure are not only realized by the above-described specific apparatuses and/or methods but may be also realized by a software program that performs functions corresponding to the elements of the exemplary embodiments or a recording medium in which the program is recorded. The above may be easily realized by those skilled in the art in view of the foregoing.

While this disclosure of invention has been provided in connection with what is presently considered to be practical exemplary embodiments, it is to be understood that the teachings are not limited to the disclosed embodiments, but, on the contrary, the teachings are intended to cover various modifications and equivalent arrangements included within the spirit and scope of the teachings.

What is claimed is:

1. A self-lighting type of display device in which output luminance is a function of analog drive voltages and corresponding digital grayscale command signals, the display device comprising:

a frame operation processor configured for generating analog dimming value signals corresponding to to-be-output ones of the analog drive voltages and configured for generating corresponding digital dimming value signals corresponding to to-be-output ones of the digital grayscale command signals, the frame operation processor being responsive to supplied current limiting parameters, the frame operation processor configured for generating control value signals using the generated analog dimming value signals, the digital dimming value signals, and measured values of a current supplied to a plurality of self-lighting sub-pixels;

an image data processor configured for changing initial grayscale digital data values of input video signals of one frame by using the digital dimming values generated by the frame operation processor;

a self-lighting type of display panel including the sub-pixels configured to display an image corresponding to the input video signals of a respective image frame; and a variable power supply configured for controlling power source voltages used to drive the sub-pixels of the display panel, the power source voltages being controlled in accordance with the control value signals generated by the frame operation processor, wherein the variable power supply is further configured to measure the values of the current supplied to the sub-pixels and output the measured values of the current to the frame operation processor.

2. The display device of claim 1, wherein the self-lighting sub-pixels include organic light emitting diodes (OLED's) and the power source voltages comprise first power source voltages supplied to anodes of the organic light emitting diodes of the plurality of sub-pixels and second power source voltages supplied to cathodes of the organic light emitting diodes, and wherein the power supply controls the first power source voltages in accordance with the control value signals generated by the frame operation processor.

3. The display device of claim 1, wherein the image data processor comprises a digital dimming operator for multiplying the grayscale data of the video signals of the frame by the digital dimming values to change the grayscale data of the video signals.

4. The display device of claim 1, wherein the control value signals are pulse width modulated (PWM) signals.

5. The display device of claim 1, wherein the control value signals are digital values for designating corresponding voltage levels.

6. The display device of claim 1, wherein a plurality of sub-pixels are divided into first sub-pixels of a first color and second sub-pixels of a different second color, wherein the power source voltages comprise a first power source voltage supplied to anodes of organic light emitting diodes of the first sub-pixels and a second power source voltage supplied to anodes of organic light emitting diodes of the second sub-pixels, and wherein the power supply controls the first power source voltage and the second power source voltage in accordance with the control value signals.

7. The display device of claim 6, wherein the control value signals comprise a first feedback control value signal corresponding to the first color and a second feedback control value signal corresponding to the second color, wherein the analog dimming values comprise a first analog dimming value corresponding to the first color and a second analog dimming value corresponding to the second color, and wherein the digital dimming values comprise a first digital dimming value corresponding to the first color and a second digital dimming value corresponding to the second color.

8. A self-lighting type of display device in which output luminance is a function of analog drive voltages and corresponding digital grayscale command signals, the display device comprising:

a frame operation processor configured for generating analog dimming value signals corresponding to to-be-output ones of the analog drive voltages and configured for generating corresponding digital dimming value signals corresponding to to-be-output ones of the digital grayscale command signals, the frame operation processor being responsive to supplied current limiting parameters, the frame operation processor configured for generating control value signals using the generated analog dimming value signals and the digital dimming value signals;

an image data processor configured for changing initial grayscale digital data values of input video signals of one frame by using digital dimming values generated by the frame operation processor;

a self-lighting type of display panel including a plurality of self-lighting sub-pixels configured to display an image corresponding to the input video signals of a respective image frame; and a variable power supply configured for controlling power source voltages used to drive the sub-pixels of the display panel, the power source voltages being controlled in accordance with the control value signals generated by the frame operation processor, wherein the supplied current limiting parameters comprise a screen color temperature, a power consumption limiting value, and a user selected dimming value, and wherein the frame operation processor comprises:

a current value operator for calculating actual current values in the frame using the screen color temperature;

a dimming value operator for generating the analog dimming values and the digital dimming values using the actual current values, the power consumption limiting value, and the user dimming value and calculating target current values in the frame using the analog dimming values and the digital dimming values; and a voltage controller for comparing measured current values of the sub-pixels with the target current values to thereby generate the control value signals.

9. The display device of claim 8, wherein the power supply includes measurement circuitry configured to measure current values drawn by the sub-pixels in response to the power source voltages supplied to the sub-pixels.

10. The display device of claim 8, wherein the voltage controller generates its control value signals such that they increase the power source voltages when the measured current values are less than the target current values.

11. The display device of claim 8, wherein the dimming value operator comprises:

a net power control (NPC) logic processor for determining a scale variable of a corresponding frame by a load factor calculated by the actual current values drawn in the frame;

a divider for dividing the scale variable into analog scale variables and digital scale variables; and a dimming value determiner for generating the analog dimming values using the analog scale variables and using the user selected dimming value and generating the digital dimming values using the digital scale values and the user dimming value.

12. The display device of claim 8, wherein the dimming value operator comprises a target current value operator for calculating the target current values by multiplications of the analog dimming values, the digital dimming values, and the actual current values.

13. A method of driving a display device including a plurality of self-lighting sub-pixels, where output luminances of the sub-pixels are functions of analog drive voltages supplied to the sub-pixels and also of corresponding digital grayscale command signals used to control the sub-pixels, the method comprising:

generating analog dimming values and digital dimming values in accordance with supplied current limiting parameters;

measuring the values of a current supplied to the sub-pixels;

generating control value signals using the generated analog dimming values, the generated digital dimming values, and the measured values of the current supplied to the sub-pixels;

controlling power source voltages supplied to the sub-pixels in accordance with the control value signals; and displaying an image corresponding to input video signals of one frame input from an external source.

14. The method of claim 13, wherein, original image, grayscale digital data is included in the input video signals and the original image, grayscale digital data is changed in accordance with the generated digital dimming values.

15. The method of claim 13, wherein self-lighting sub-pixels include organic light emitting diodes (OLED's) and the power source voltages are supplied to anodes of the organic light emitting diodes of the plurality of sub-pixels.

16. The method of claim 13, wherein a plurality of sub-pixels are divided into first sub-pixels of a first color and second sub-pixels of a different second color, and wherein the power source voltages comprise a first power source voltage supplied to anodes of organic light emitting diodes of the first sub-pixels and a second power source voltage supplied to anodes of organic light emitting diodes of the second sub-pixels.

17. The method of claim 13, wherein the current limiting parameters comprise a screen color temperature, a power consumption limiting value, and a user selected dimming value, and the generating of the analog dimming values and the digital dimming values comprises:

calculating actual current values of the video signals using the screen color temperature;

calculating analog scale variables and digital scale variables using the actual current values and the power consumption limiting value;

generating the analog dimming values using the analog scale variables and the user dimming value; and generating the digital dimming values using the digital scale variables and the user dimming value.

18. The method of claim 13, wherein the generating of the control value signals comprises:

calculating target current values in the frame using the analog dimming values and the digital dimming values;

measuring current values flowed by power source voltages and supplied to the plurality of sub-pixels; and comparing the measured current values with the target current values to generate the control value signals.

19. The method of claim 18, wherein comparing the measured current values with the target current values to generate the control value signals comprises:

generating control value signals that increase the respective power source voltages when the measured current values are less than the target current values; and generating control value signals that reduce the respective power source voltages when the measured current values are not less than the target current values.

20. The method of claim 13, wherein the control value signals are pulse width modulated (PWM) signals.

21. The method of claim 13, wherein the control value signals are digital values for designating corresponding voltage levels.

* * * * *